US005649871A

United States Patent [19]

Ryan

[11] Patent Number: 5,649,871

[45] Date of Patent: Jul. 22, 1997

[54] GOLF CLUB SIGHTING AND ALIGNMENT SYSTEM

[75] Inventor: William H. Ryan, Staten Island, N.Y.

[73] Assignee: Quantum Leap Golf Company, L.L.C., Basking Ridge, N.J.

[21] Appl. No.: 591,072

[22] Filed: Jan. 25, 1996

[51] Int. Cl.[6] ..... A63B 69/36

[52] U.S. Cl. ..... 473/242; 473/268

[58] Field of Search ..... 473/242, 268

[56] References Cited

U.S. PATENT DOCUMENTS 5,429,366 7/1995 McCabe ..... 473/242 X

*Primary Examiner*—George J. Marlo

*Attorney, Agent, or Firm*—Q. Todd Dickinson; Stephen T. Falk

[57] ABSTRACT

The present invention provides for a "rifle sighting system" on the top surface of the clubhead which allows the golfer at the address position to align the ball where the center marker on the clubface will be at impact. This system factors in the effect the downward bowing of the shaft on the forward swing has on the center of the clubface's position at impact. It also factors in the parallax visual error the golfer experiences as he tries to align the center of the clubface to the ball.

11 Claims, 2 Drawing Sheets

GOLF CLUB SIGHTING AND ALIGNMENT SYSTEM

BACKGROUND OF THE INVENTION

This invention pertains to a means for correcting the alignment of a golf club head relative to the golf ball at address by providing the golfer means for compensating for two effects: the bowing of the golf club during its forward swing and the golfer's visual parallax error.

It is well known that during the forward swing the shaft of the club bows downward due to centrifugal forces. This causes the clubhead and its center of gravity to be shifted heelward toward the golfer. Traditional alignment systems do not work properly because they do not account for this movement or shifting. As a result, golfers must either attempt to compensate in their swing or risk miss-hitting the ball toward the toe of the clubface.

In addition, there is a visual parallax error when addressing the golf ball created by the golfer's view down through the top of the leading edge of the clubhead to the center of the clubface. Traditional sighting devices on the top center of the clubhead also fail to account for this error, causing the golfer to misalign the ball towards the toe side of the clubface.

An alignment system is needed which factors in both the effect that the bowing of the shaft and visual parallax error have on aligning the center of the clubface to the ball.

An object of the present invention is to provide such an alignment system. This alignment system will enable the golfer to use a rifle sight line device on the top surface of the clubhead to position the clubhead so that the actual center of the clubface, or "sweet spot", will impact with the ball during the swing.

SUMMARY OF THE INVENTION

The main object of this invention is to provide a simple and consistent means for a golfer to make contact between the ball and the true center of the clubface at the one time it truly matters: impact with the ball.

The present invention is a golf clubhead, comprising a top surface, a striking surface having an impact marker, a forward edge line formed by the intersection of said top surface and said striking surface, a heelward end at which a longitudinal golf club shaft is affixed, and a toeward end opposite said heelward end. The clubhead includes alignment means for compensating for and correcting both the bowing of the golf club shaft during forward swing and the golfer's visual parallax error. The alignment means comprises at least one sight line device on the top surface of the clubhead with a forward end at the forward edge line of the clubhead, wherein (1) the sight line device forms an angle of approximately 18° to 26° relative to a line on the top surface perpendicular to the forward edge line, and (2) the forward end of said sight line device is situate heelward from a point on the top surface directly above the resting center of gravity of the striking surface a distance sufficient to compensate for the bowing of the shaft during the swing. Preferably, that distance is approximately ¼ of an inch.

In one embodiment of the invention, the sight line device comprises a plurality of lines radiating from a common point on the forward edge line of the clubhead, ¼ inch heelward from a point directly above the impact center of the striking surface. These lines are arranged at angles in the range from approximately 18° to approximately 26° relative to a perpendicular formed by a line on the striking surface passing through the center of the striking face and the forward edge line. The preferred angle of the sight line device is approximately 22°.

DETAILED DESCRIPTION OF THE INVENTION

Figure 1:
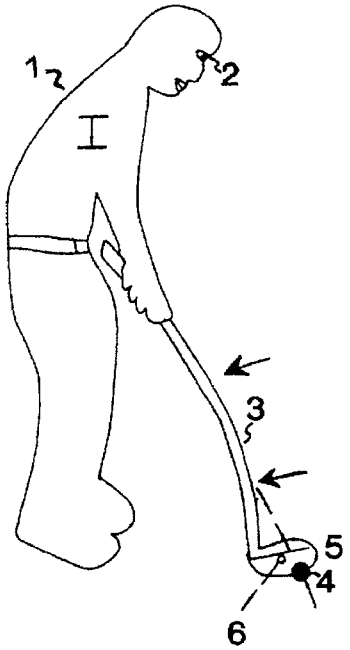
FIG. 1 is a view of the golfer at impact with the ball.

When addressing the ball, the golfer tries to align the ball to the center of the clubface. The golfer uses the top center of the clubhead with or without a traditional alignment marker to align the ball to what appears to be the center of the clubface. Because of the visual parallax error created by the angle of the golfer's vision, a misalignment can and often does occur. The golfer will place the ball where he thinks the center of the clubface is, but the parallax angle will cause him to actually place the ball further towards the toe of the clubface than the actual sweetspot. The present invention overcomes this problem.

The present invention comprises a golf clubhead, comprising a top surface, a striking surface having a center marker, a forward edge line formed by the intersection of said top surface and said striking surface, a heelward end at which a longitudinal golf club shaft is affixed, and a toeward end opposite said heelward end; said clubhead comprising alignment means for compensating for the effects of the bowing of the golf club shaft during forward swing and the golfer's visual parallax error. The alignment means comprises at least one sight line device on the top surface of the clubhead with a forward end at the forward edge line, wherein (1) the sight line device forms an angle of approximately 18° to 26° relative to a perpendicular formed by a line on the striking surface passing through the impact center of gravity and the forward edge line, and (2) the forward end of the sight line device is situate heelward from a point on said top surface directly above the center point of the striking surface a distance sufficient to compensate for said bowing. Preferably, that distance is approximately ¼ of an inch.

By testing the vision angles of golfers, of different heights, stances and postures, the range of the visual parallax error was established as an angle off of vertical between 18 to 26 degrees. By using the average angle of 22 degrees, a standard or medium angle can be used which will allow the majority of golfers to align a top-of-the-clubhead sight line device to the center of the ball.

As discussed above, the difficulty in aligning the ball to the center of the clubface is further compounded by the fact that the center moves approximately ¼ of an inch towards the heel as the shaft of the club bows downward during the forward swing. This is a well known occurrence. See, for example, R. Maltby, *The Fitting Program*, July 1986, p.8 under club fitting variables No.4, club length.

In the present invention, by placing a marker, preferably on the clubface's impact center, at a point approximately ¼ of an inch laterally towards the heel of the clubface's exact center and on the same latitude, an impact marker can be established. While ¼ of an inch is a preferred displacement, the impact marker is more generally displaced a lateral distance sufficient to compensate for the bowing of the club shaft during the swing. Preferably, the marker is a circular marker. The diameter of a circular impact marker can be of any radius, but one from approximately ¼ to approximately ½ of an inch is suitably effective.

In the present invention a sight line device is placed on the top surface of the clubhead. This sight line device is placed in such a way so as to allow the golfer to properly align the impact marker on the clubface and the ball prior to initiating a swing of the golf club. The alignment is performed by lining up the sight line device and the impact marker as viewed by the golfer with the center of the golf ball.

In order to compensate for and correct the bending and parallax effects described above, the sight line device is positioned on the top surface of the clubhead at an angle of between approximately 18 and 26 degrees off the perpendicular formed by a line passing through the impact center of gravity on the striking surface of the clubhead and the forward edge line of the clubhead which is formed by the intersection of the top surface and the striking surface of the clubhead. Further, the forward end of the sight line device, i.e., the end at the forward edge line, is situate approximately ¼ of an inch heelward from the point directly above the impact marker on the striking surface.

The angle of the sight line device may be tailored to affect appropriate compensation for any degree of visual parallax error. As noted above, the parallax error will vary depending on the physical characteristics of the golfer and the structure, i.e., length and angles, of the golf club. It is within the ability of the practitioner in the art to determine the degree of parallax error and affect the compensation therefor.

Likewise, the extent of displacement of the center of gravity relative to the golf ball during the forward swing, i.e., the bending of the golf club shaft, may vary. The bending will be a function of various parameters, including the length and composition of the club shaft and the speed and steadiness of the golfer's forward swing. As noted above, ¼ of an inch is a preferred displacement distance; however, it is within the ability of the manufacturer to determine the degree of bending and affect the compensation therefor during manufacture.

The sight line device comprises a marking on the top surface of the clubhead. The size and composition of the sight line device are not critical. It may comprise a groove in the top surface. Alternatively, it may comprise a line painted or otherwise applied to the surface of the top surface of the clubhead. In one embodiment of the invention, the sight line device may be in the form of an arrow with the forward point of the arrow placed at the forward edge line of the clubhead. Alternatively, the device may be in the form of a logo or printed legend. However formed, it is important that the sight line device be visible to the golfer when addressing the ball.

The invention may be further described with reference to FIGS. 1 through 6. These figures illustrate one embodiment of the invention, namely drivers and fairway woods, but may be applicable as well to any iron with appropriate adjustments within the ability of the practitioner in the art.

FIG. 1 shows the customary position of the club's center 6 when striking the ball 4 showing how centrifugal force bows the shaft 3 downward during forward swing of the golf club.

Figure 2:
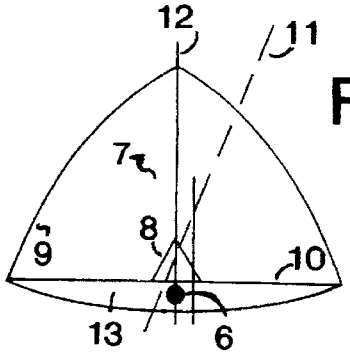
FIGS. 2 and 2A are a top view and frontal view, respectively, of the clubhead and clubface with a center of the clubhead alignment marker.

FIG. 2 shows a top view of the clubhead 7 with a traditional centered sighting device 8 on the forward edge 10 of the top surface and the parallax view 11 the golfer would experience as his view goes across the clubface 13.

Figure 2A:
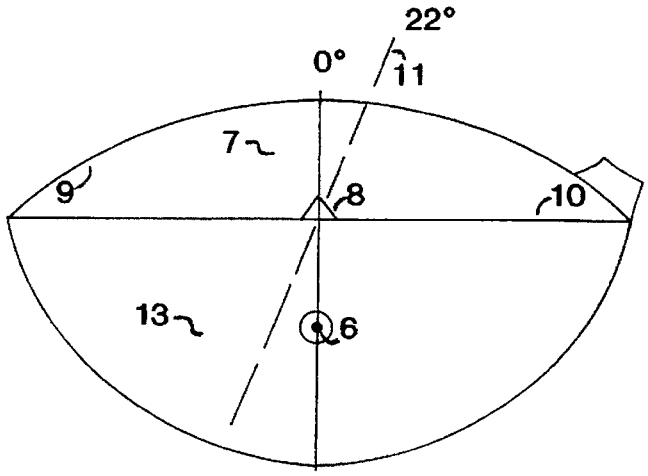

FIG. 2A shows a frontal view of the clubface 13 showing that the parallax vision line 11 will cross the center alignment marker 8 at an angle of between 18° to 26°. The parallax vision line is shown at a median angle of approximately 22° off of the perpendicular formed by a line passing through the center of the clubface 6 and the top forward edge line of the clubface 10.

Figure 3:
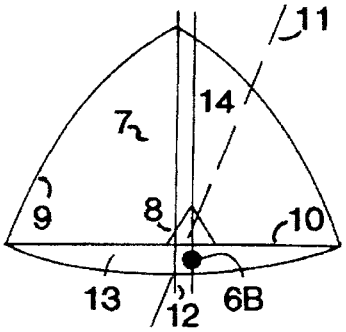
FIG. 3 is a frontal view of the clubface and top of the clubhead.

FIG. 3 shows a top view of the clubhead 7 with a sight line device 8 displaced ¼ of an inch heelward along the forward edge 10 of the top surface in order to lie on the perpendicular formed by a line passing through the point 6B longitudinally displaced ¼ of an inch heelward from the impact center (6 in FIG. 2A) and the top forward edge of the clubface 10. It also shows the parallax view 11 the golfer would experience as his view goes across the clubface 13.

Figure 3A:
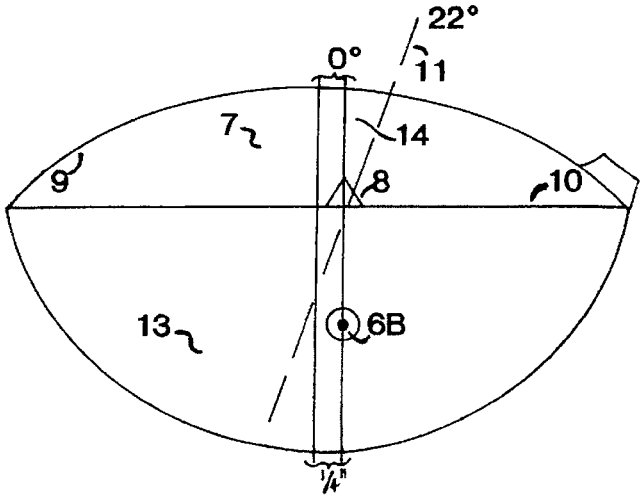
FIG. 3A is a front top view of the clubhead and clubface showing the visual parallax error line.

FIGS. 3A shows a frontal view of clubface 13 and the top of the clubhead 7 similar to FIG. 3. It further illustrates that the clubface center 6B will be displaced ¼ of an inch heelward at impact.

Figure 4:
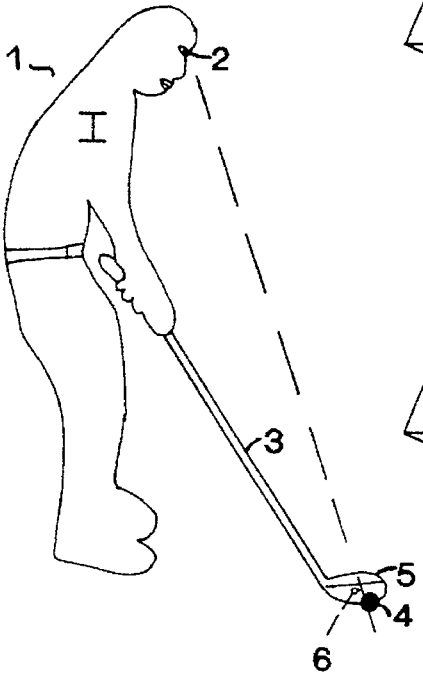
FIG. 4 is a view of a golfer addressing a ball.

FIG. 4 shows the position of a golfer 1 with golf club when addressing the ball 4. The clubhead 5 is shown with its center impact marker 6. The figure further shows the visual sight line from the golfer's sight eye 2 to the center impact marker 6.

Figure 5:
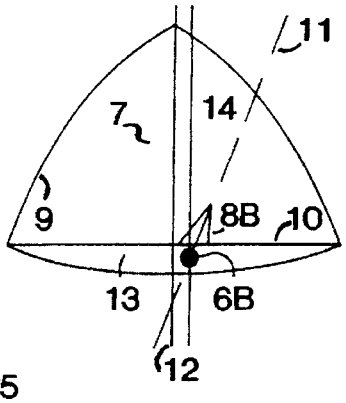
FIG. 5 is a front top view of the clubhead and clubface.
Figure 5A:
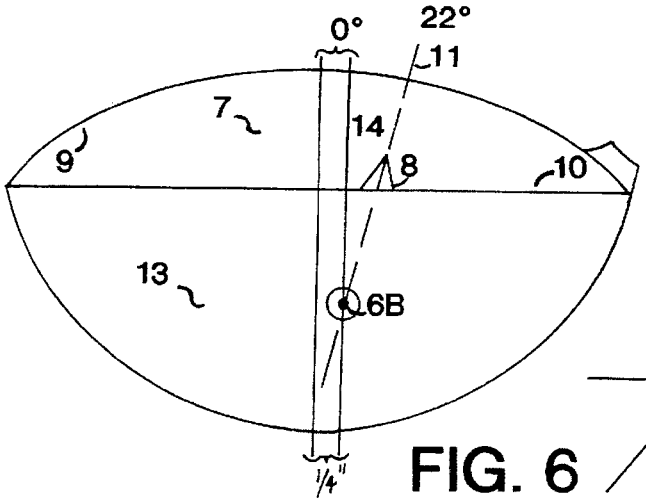
FIG. 5A is a frontal view of the clubface and top of the clubhead.

FIGS. 5 and 5A show a top view and a frontal view, respectively, of the clubhead 7 and the clubface 13. It more clearly illustrates the parallax line 11 as it goes through the center of the repositioned alignment device 8B towards the center of the clubface at impact 6B.

Figure 6:
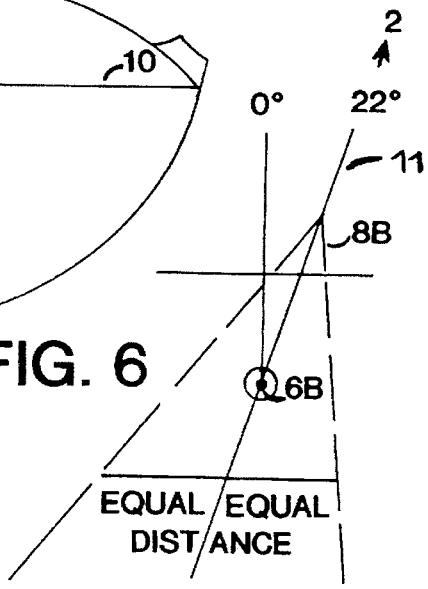
FIG. 6 is an illustration of the top of the sight line device at a 22° angle.

FIG. 6 is an illustration of the top of the clubhead sight line device 8, in the form of an arrow, which is tilted on a 22° angle along the parallax line 11 through the center circle 6B of the club face towards the golfer's eyes 2.

The angles and distances used are averages and are meant to have a latitude to cover golfers of different heights, postures and stances, as well as a variety of golf clubhead swing speeds.

One advantage of the present invention is to create an alignment system which factors in the effect the downward bowing of the shaft during the forward swing has upon the relative position of the clubface's center. A further advantage of the invention is to provide a sight line device which factors in the golfer's parallax vision error at address. The resulting invention yields a golf club alignment and sighting system which makes it possible to align the ball at address through the "Rifle Sight" sight line device when it counts most, at impact with the ball.

Numerous variations or modifications of this invention, all within the scope of the invention, will readily occur to those skilled in the art. All such modifications and variations are considered to be within the scope this invention. Accordingly, the foregoing detailed description is but one variation of the invention used to demonstrate the principals for the invention and the invention is not limited thereto. The scope of this invention is to be determined solely by the claims included herein.

What is claimed is:

1. A golf clubhead, comprising a top surface, a striking surface having a center point, a forward edge line formed by the intersection of said top surface and said striking surface, a heelward end at which a longitudinal golf club shaft may be affixed, and a toeward end opposite said heelward end; said clubhead comprising alignment means for compensating for and correcting the bowing of said golf club shaft during forward swing and the golfer's visual parallax error, said alignment means comprising at least one sight line device on said top surface of said clubhead with a forward end at said forward edge line, wherein (1) said sight line device forms an angle of approximately 18° to 26° relative to a line on the top surface perpendicular to said forward edge line, and (2) said forward end of said sight line device is situate heelward from a point on said top surface directly above said center point of said striking surface a distance sufficient to compensate for said bowing.

2. The clubhead according to claim 1, wherein said angle is approximately 22° relative to the front surface of said clubhead.

3. The clubhead according to claim 1 wherein said distance is approximately ¼ of an inch.

4. The clubhead according to claim 1, further comprising an impact marker on said striking surface, wherein said impact marker is centered at a point heelward from said center point of said striking surface a lateral distance sufficient to compensate for said bowing.

5. The clubhead according to claim 4, wherein said lateral distance is approximately ¼ of an inch.

6. The clubhead according to claim 4, wherein said impact marker comprises a circular marker.

7. The clubhead according to claim 6, wherein said impact marker comprises a circular marker having a radius of approximately ¼ of inch to approximately ½ of an inch.

8. The clubhead according to claim 1, wherein said sight line device comprises a plurality of lines radiating from a common point directly above said center of gravity of said striking surface at angles in the range from approximately 18° to approximately 26° relative to said striking surface.

9. The clubhead according to claim 1, wherein said sight line device comprises at least one groove formed in said top surface.

10. The clubhead according to claim 1, wherein said sight line device comprises at least one surface marking on said top surface.

11. The clubhead according to claim 10, wherein said surface marking comprises a logo or written legend.

* * * * *